US006202919B1

(12) United States Patent
Hathi

(10) Patent No.: US 6,202,919 B1
(45) Date of Patent: Mar. 20, 2001

(54) COMBINATION LETTER AND ENVELOPE

(76) Inventor: Kanaiyalal J. Hathi, 12 Lochinvar La., Oak Brook, IL (US) 60523

( * ) Notice: Subject to any disclaimer, the term of this patent is extended or adjusted under 35 U.S.C. 154(b) by 0 days.

(21) Appl. No.: 09/511,255

(22) Filed: Feb. 23, 2000

(51) Int. Cl.[7] ..... B65D 27/00
(52) U.S. Cl. ..... 229/92.1
(58) Field of Search ..... 229/92.1, 92.3

(56) References Cited

U.S. PATENT DOCUMENTS

| | | | | |
|---|---|---|---|---|
| 32,167 | * | 4/1861 | Dodge | 229/92.1 |
| 1,000,466 | | 8/1911 | Watson . | |
| 1,014,441 | * | 1/1912 | Benton | 229/92.1 |
| 1,291,889 | * | 1/1919 | Hopkins | 229/92.1 |
| 1,708,574 | | 4/1929 | Hazen . | |
| 1,794,223 | | 2/1931 | Zabek . | |
| 1,954,971 | | 4/1934 | Woodward . | |
| 2,549,199 | | 4/1951 | Hodska . | |
| 2,872,100 | | 2/1959 | Coffin . | |
| 3,197,121 | | 7/1965 | Hayes . | |
| 4,706,878 | | 11/1987 | Lubotta . | |
| 4,744,509 | | 5/1988 | Bucher-Dopheide . | |
| 4,928,875 | | 5/1990 | Hutchinson . | |
| 5,174,493 | | 12/1992 | File . | |

* cited by examiner

*Primary Examiner*—Jes F. Pascua
(74) *Attorney, Agent, or Firm*—Robert L. Marsh

(57) ABSTRACT

A page of paper or other suitable writing material having parallel long edges and parallel short edges as a first and a second fold which are not parallel to each other but connect the short edges of the page. The page further has a third and fourth fold parallel to the short edges. When the page is folded along the first and second folds, the distance between the first and second folds along the first short edge is greater than the distance between the first and second folds along the second short edge. When thereafter the page is folded along the third and fourth folds, the second short edge can be fitted within the first short edge to configure the page as an envelope.

2 Claims, 3 Drawing Sheets

COMBINATION LETTER AND ENVELOPE

The present invention relates to the preparation of a letter suitable for delivery using the U.S. mails and, in particular, to a page of writing material which when folded comprises its own envelope.

BACKGROUND OF THE INVENTION

The existence of the computer has enabled a single machine to produce simultaneous mailings to a vast number of people. It has, therefore, become desirable to provide a simplified and inexpensive means for mailing such documents.

Several efforts have been made to develop a single page product that can be configured as an envelope suitable for delivery through the U.S. mails and, when opened, give the appearance of a formal letter. Lubotta, et. al., U.S. Pat. No. 4,706,878 discloses one such combination letter and envelope suitable for use with a computer which employs a coating of glue along the edges of the document to retain the document in the envelope configuration. Hutchinson, U.S. Pat. No. 4,928,875 and Hays, U.S. Pat. No. 3,197,121 disclose similar single page documents which are folded and glued into an envelope configuration.

Virtually all existing methods for providing a page of paper which is suitable for conveying information in the form of a letter and foldable into an envelope configuration require glue, staples, or some other retaining means to maintain the page in the envelope configuration. The assembly of the envelope, therefore, involves a gluing or stapling stage which increases the cost of the assembling and mailing of such products. It would be desirable, therefore, to provide a method of converting a page of paper suitable for use as a letter into an envelope configuration which does not require the use of glue, staples, or other conventionally used means for retaining paper in a given configuration.

SUMMARY OF THE INVENTION

Briefly, the present invention is embodied in a rectangular page of paper or other writing material suitable for receiving written correspondence. The rectangular page of material has a first side for receiving correspondence and a second side for receiving the addresses of the recipient and sender positioned in locations which, when the page is folded as further described below, present the appearance of an envelope suitable for mailing.

The rectangular page has first and second parallel opposing long edges which define a length and first and second parallel opposing short edges which define a width. A first fold, having a first end connecting to the first short edge, and a second end connecting to the second short edges is spaced a short distance from the first long edge and a second fold having a first end connecting to the first short edge and a second end connecting to the second short edge is spaced a short distance from the second long edge. The distance between the first end of the first fold and the first end of the second fold is greater than the distance between the second end of the first fold and the second end of the second fold, such that the first and second folds are not parallel to each other.

A third fold is positioned parallel to the short edges and is connected to the first long edge and the second long edge and a forth fold is parallel to the short edges and to the third fold, is positioned between the third fold and the second short edge and also connects the first long edge and the second long edge. In the preferred embodiment, the distance separating the third fold and the fourth fold is greater than the distance between the first short edge and the first fold and greater than the distance between the second short edge and the fourth fold.

To assemble the letter into an envelope configuration, the page is first folded along the first and second folds, after which the page is then folded along the third and fourth folds. Since the distance between the first and second folds, along the second short edge, is less than the distance between the first and second folds along the first short edge, the second short edge can be inserted between the folds of the first short edge to thereby configure the page into an envelope.

The printed material on the second side of the page should be positioned such that when the page is configured as an envelope, the addresses of the sender and of the recipient are positioned on the visible portions of the envelope so that they will be properly interpreted by postal authorities.

BRIEF DESCRIPTION OF THE DRAWINGS

A better understanding of the present invention will be had after a reading of the following detailed description taken in conjunction with the drawings wherein.

DETAILED DESCRIPTION OF THE PREFERRED EMBODIMENT

Figure 1:
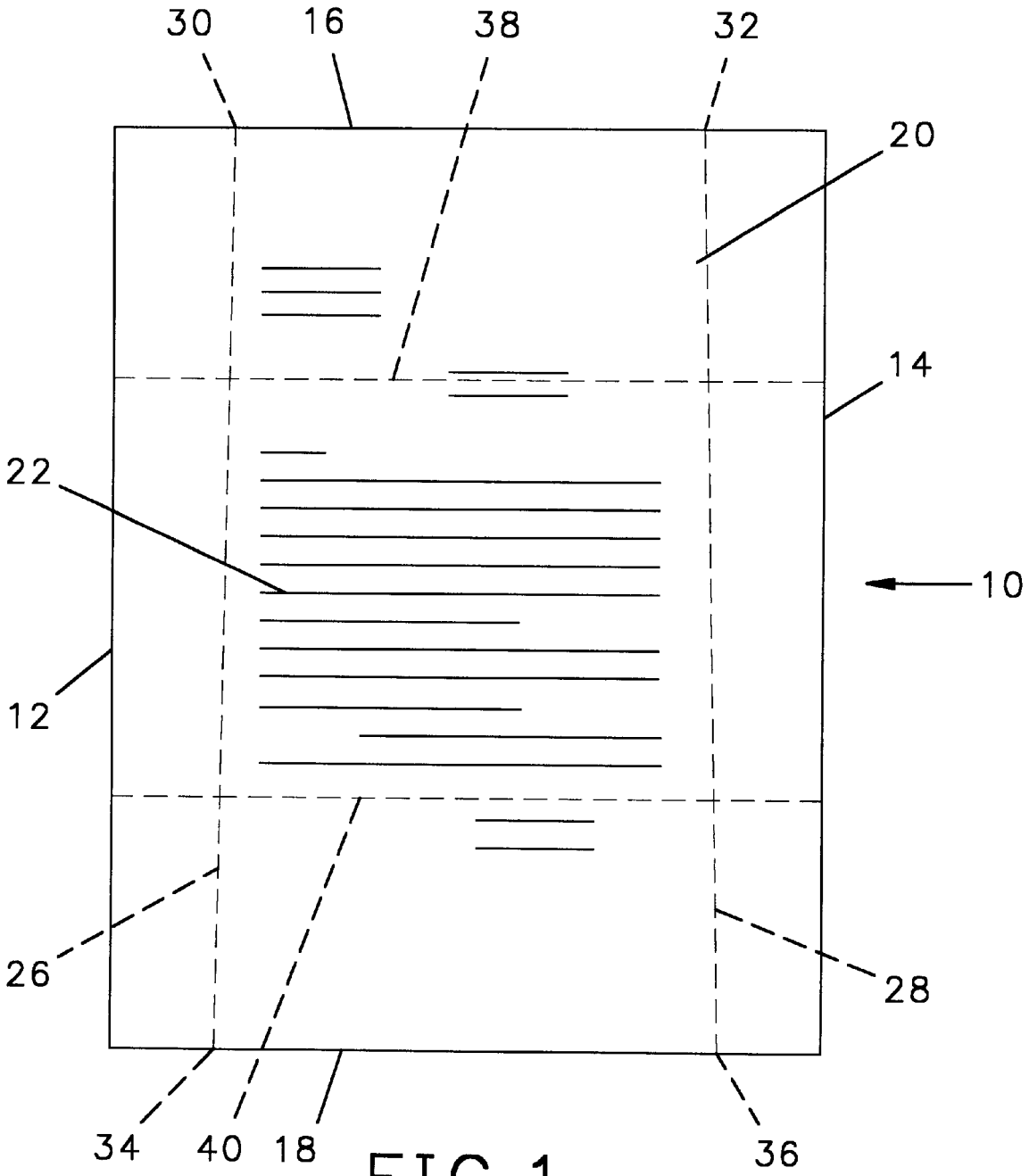
FIG. 1 is a front elevational view of a page having correspondence printed on the first surface thereof and having fold marks for configuring the page into an envelope.
Figure 5:
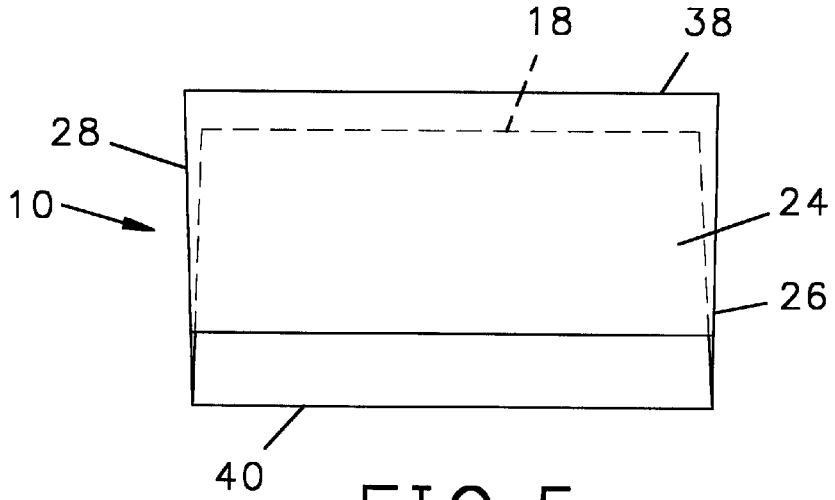
FIG. 5 is a back view of the envelope configuration shown in FIG. 3.

Referring to FIG. 1, a rectangular page 10 of paper or other similar planar material having the limited degree rigidity which is characteristic of the paper commonly used for bearing written correspondence or employed in the manufacture of envelopes and the like has a first long edge 12, a second parallel long edge 14, and perpendicular to the long edges are a first short edge 16 and a second parallel short edge 18. The page 10 further has a first side 20 suitable for receiving correspondence 22 thereon and an opposing second side 24 (only partially visible in FIGS. 3 and 5).

The correspondence 22 is suitably positioned to give the first side of the page the appearance of a readily readable piece of correspondence.

Positioned near the first long edge and spaced a short distance therefrom is a first fold 26 which extends from the first short edge 16 to the second short edge 18. Similarly, positioned along the second long edge 14, and spaced a short distance therefore, is a second fold 28 which extends from the first short edge 16 to the second edge 18 as shown.

In accordance with the present invention, the first fold and the second fold are not parallel to each other although either the first fold or the second fold may be oriented parallel to the long edges 12, 14. Since the first fold 26 and the second fold 28 are not parallel to each other, the distance between the first end 30 of the first fold 26 and the first end 32 of the second fold 28 is greater than the distance between the second end 34 of the first fold 26 and the second end 36 of the second fold 28 as shown.

As can be seen, the first fold 26 is positioned near the first long edge 12 and the second fold 28 is positioned near the second long edge 14 such that the spacing between the first fold and the second fold is substantially greater than the spacing between either of the folds 26, 28 and the neighboring long edge 12, 14.

Positioned parallel to the first and second short edges 16, 18 and spaced less than a third of the distance down the page 10 is a third fold 38 extending from the first long edge 12 to the second long edge 14. Also positioned parallel to the first and second short edges 16, 18 and between the third fold 38 and the second short edge 18 is a fourth fold 40 extending from the first long edge 12 to the second long edge 14. As can be seen, the third and fourth folds are positioned on the page 10 such that the distance between the third fold 38 and the fourth fold 40 is greater than the distance between the third fold 38 and the first short edge 16 and greater than the distance between the second fold 40 and the second short edge 18.

Figure 2:
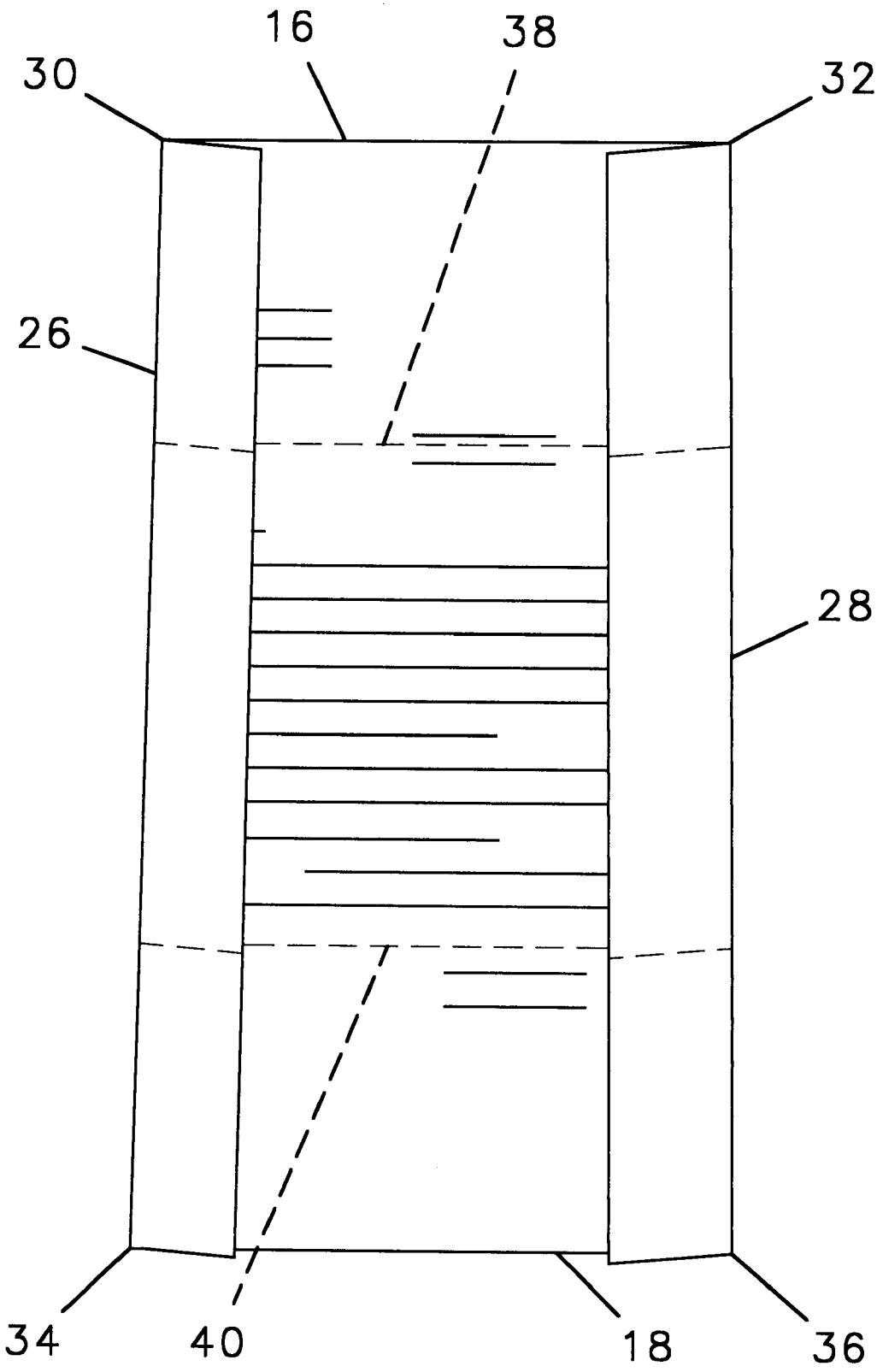
FIG. 2 is a front elevational view of the page shown in FIG. 1 after being folded along the first and second fold lines.

To assemble the page 10 into an envelope configuration, the page 10 is first folded along the first fold 26 with the first long edge 12 folded against the first side 20 of the page 10. Next the page is folded along the second fold 28 with the second long edge 14 folded against the first side 20 after which the page is in the configuration shown in FIG. 2. Thereafter, the page 10 is folded along the third fold 38 with the first short side 16 folded against the first side 20, after which the page 10 is folded along the fourth fold 40 with the second short edge 18 folded against the first side 20.

Figure 3:
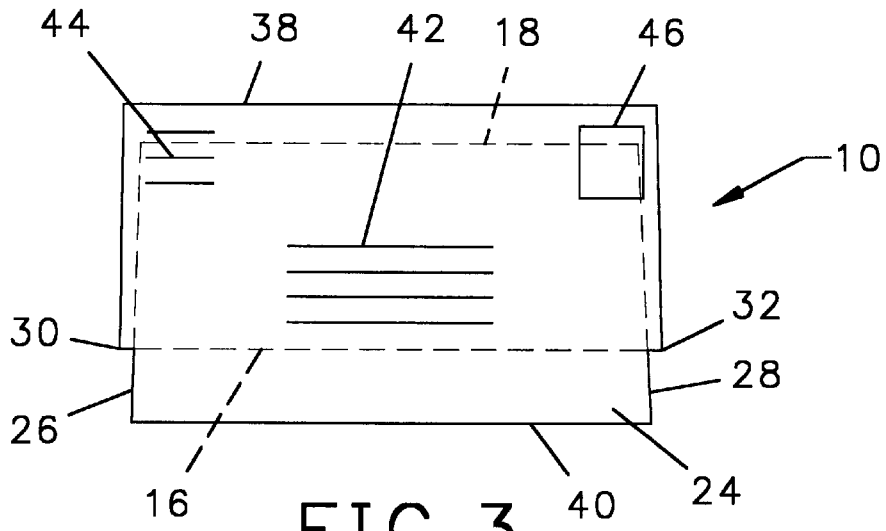
FIG. 3 is a front elevational view the page shown in FIG. 1 configured into an envelope with the concealed portions thereof shown in broken lines.
Figure 4:
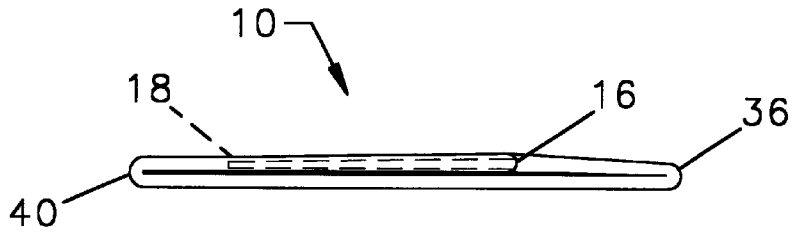
FIG. 4 is a side elevational view of the page shown in FIG. 1 assembled into the envelope configuration shown in FIG. 3.

Since the distance between first end 30 for the first fold 26 and the first end 32 of the second fold 28 Is greater than the distance between the second end 34 of the first fold 26 and the second end 36 of the second fold 28, the second short edge 18 can then be fitted between the first and second folds of the first short edge 16 as shown in FIGS. 3 and 4. When the folds 26, 28, 38, 40 are thereafter all creased, only portions of the second side 24 will be visible and it will present the views shown in FIGS. 3 and 5, and give the appearance of an envelope. Printed on the second side 24 is the address 42 of the recipient of the correspondence and the address, or other information, 44 from the sender. A portion 46 of the second side 24 may also be designated for receiving postage as shown.

There has, therefore, been described a page 10 having a first side 20 suitable for receiving correspondence 22 and a second side 24 on with mailing information is printed suitable for interpreting by the Post Office for the transferring of the document from the sender to the recipient.

While the present invention has been described with respect to a single embodiment, it will be appreciated that many modifications and variations can be made without departing from the true spirit and scope of the invention. It is, therefore, the intent of the appendant claims to cover all such modifications and variations which fall within the true spirit and scope of the invention.

What is claimed:

1. A combined letter and envelope comprising a rectangular page of writing material having a first side, a second side, parallel opposing first and second long edges defining a length, and parallel opposing first and second short edges defining a width, a first fold having a first end at said first short edge and a second end at said second short edge, said first fold spaced a short distance from said first long edge, a second fold having a first end at said first short edge and a second end at said second short edge, said second fold spaced a short distance from said second long edge, said first end of said first fold spaced a distance from said first end of said second fold which is greater than the distance said second end of said first fold is spaced from said second end of second fold, a third fold parallel to said short edges, said third fold connecting said first long edge and said second long edge, a fourth fold parallel to said short edges, said fourth fold connected to said first long edge and said second long edge, and said second long edge with said first and second folds therein fitting within said first and second folds of said first short edge.

2. The method of configuring a page of paper into an envelope comprising the steps of providing said page of paper having a first side, a second side, parallel opposing first and second long edges defining a length, and parallel opposing first and second short edges defining a width, forming a first fold spaced a short distance from said first long edge, said first fold extending from said first short edge to said second short edge, and having a first end and a second end, forming a second fold spaced a short distance from said second long edge, said second fold extending from said first short edge to said second short edge with said first end of said first fold spaced a distance from a first end of said second fold which is greater than the distance said second end of said first fold is spaced from a second end of said second fold, forming a third fold parallel to said short edge, forming a fourth fold parallel to said short edge, and inserting said first and second folds of said first short ends between said first and second folds of said second short end to form said envelope.

* * * * *